US008915002B2

(12) United States Patent
Aho

(10) Patent No.: US 8,915,002 B2
(45) Date of Patent: Dec. 23, 2014

(54) SELF ILLUMINATED SIGNAGE FOR PRINTED GRAPHICS

(71) Applicant: 3M Innovative Properties Company, St. Paul, MN (US)

(72) Inventor: Erik A. Aho, North Saint Paul, MN (US)

(73) Assignee: 3M Innovative Properties Company, Saint Paul, MN (US)

( * ) Notice: Subject to any disclaimer, the term of this patent is extended or adjusted under 35 U.S.C. 154(b) by 55 days.

(21) Appl. No.: 13/755,083

(22) Filed: Jan. 31, 2013

(65) Prior Publication Data

US 2014/0208624 A1 Jul. 31, 2014

(51) Int. Cl.

| | |
|---|---|
| ***G09F 13/02*** | (2006.01) |
| ***G09F 13/14*** | (2006.01) |
| ***G09F 13/04*** | (2006.01) |

(52) U.S. Cl.

CPC ..... *G09F 13/14* (2013.01); *G09F 13/04* (2013.01)

USPC ..... 40/559; 40/582; 40/561; 40/562

(58) Field of Classification Search

CPC ..... G09F 13/16; G09F 13/02

USPC ..... 40/582, 559, 561, 562

See application file for complete search history.

(56) References Cited

U.S. PATENT DOCUMENTS

| | | | | |
|---|---|---|---|---|
| 1,856,462 | A * | 5/1932 | Burns | 40/562 |
| 4,995,185 | A * | 2/1991 | Cheng | 40/582 |
| 5,759,671 | A * | 6/1998 | Tanaka et al. | 428/166 |
| 6,470,610 | B1 * | 10/2002 | Northey | 40/582 |
| 6,790,578 | B1 * | 9/2004 | Rajan et al. | 430/120.2 |
| 6,791,642 | B1 | 9/2004 | Wang | |
| 7,165,959 | B2 | 1/2007 | Humlicek | |
| 7,224,529 | B2 | 5/2007 | King | |
| 7,278,775 | B2 | 10/2007 | Yeo | |
| 8,007,118 | B2 | 8/2011 | O'Neill | |
| 8,248,554 | B2 | 8/2012 | Qi | |
| 8,300,301 | B2 | 10/2012 | Noh | |
| 2002/0018279 | A1 | 2/2002 | Molsen | |
| 2006/0090385 | A1 | 5/2006 | Jurkovic | |
| 2006/0239629 | A1 | 10/2006 | Qi | |
| 2007/0058254 | A1 * | 3/2007 | Kim | 359/530 |
| 2010/0141869 | A1 | 6/2010 | Biernath | |
| 2010/0171929 | A1 | 7/2010 | Liu | |
| 2011/0051047 | A1 | 3/2011 | O'Neill | |
| 2011/0122493 | A1 | 5/2011 | Ogawa | |

FOREIGN PATENT DOCUMENTS

| | | |
|---|---|---|
| JP | 2006-189609 | 7/2006 |

OTHER PUBLICATIONS

PCT International Search Report for PCT/US2014/012184, mailed May 9, 2014.

* cited by examiner

*Primary Examiner* — Gary Hoge

(57) ABSTRACT

Self illuminated back and front lit signage for a printed graphic. The signage includes a turning film having a structured surface for redirecting light, a diffuser providing for diffusion, and a printed graphic. The turning film receives light from an ambient light source and directs the light via the structured surface toward a viewer of the graphic in order to passively illuminate the signage.

5 Claims, 3 Drawing Sheets

SELF ILLUMINATED SIGNAGE FOR PRINTED GRAPHICS

BACKGROUND

Printed graphics have been used for advertising, safety, and personal uses for many years. These displays have become so commonplace that it may often be difficult to have a message noticed in a crowd of such signs. One common solution to this occurrence is to actively backlight a digital or static graphic in order to attract more attention. However, this active backlighting can come at a cost of requiring more energy and electronics, and producing more heat in a given environment, all of which may not be desirable. Accordingly, a need exists for ways to illuminate or otherwise draw more attention to static graphic signage.

SUMMARY

A self illuminated back lit sign, consistent with the present invention, includes a turning film having a structured surface for redirecting light, a diffuser providing for diffusion in at least one direction, and a graphic on the diffuser. The turning film directs light via the structured surface toward a viewer of the graphic in order to passively illuminate the sign.

A self illuminated front lit sign, consistent with the present invention, includes a diffuser for providing diffusion in at least one direction, a graphic on the diffuser, a turning film having a structured surface for redirecting light, and a reflector on the turning film. The turning film directs light via the structured surface toward a viewer of the graphic in order to passively illuminate the sign.

Another self illuminated front lit sign, consistent with the present invention, includes a turning film having a structured surface for redirecting light, a diffuser on the turning film and providing for diffusion in at least one direction, a graphic on the turning film, and a reflector on the diffuser. The turning film directs light via the structured surface toward a viewer of the graphic in order to passively illuminate the sign.

BRIEF DESCRIPTION OF THE DRAWINGS

The accompanying drawings are incorporated in and constitute a part of this specification and, together with the description, explain the advantages and principles of the invention. In the drawings.

DETAILED DESCRIPTION

Figure 1:
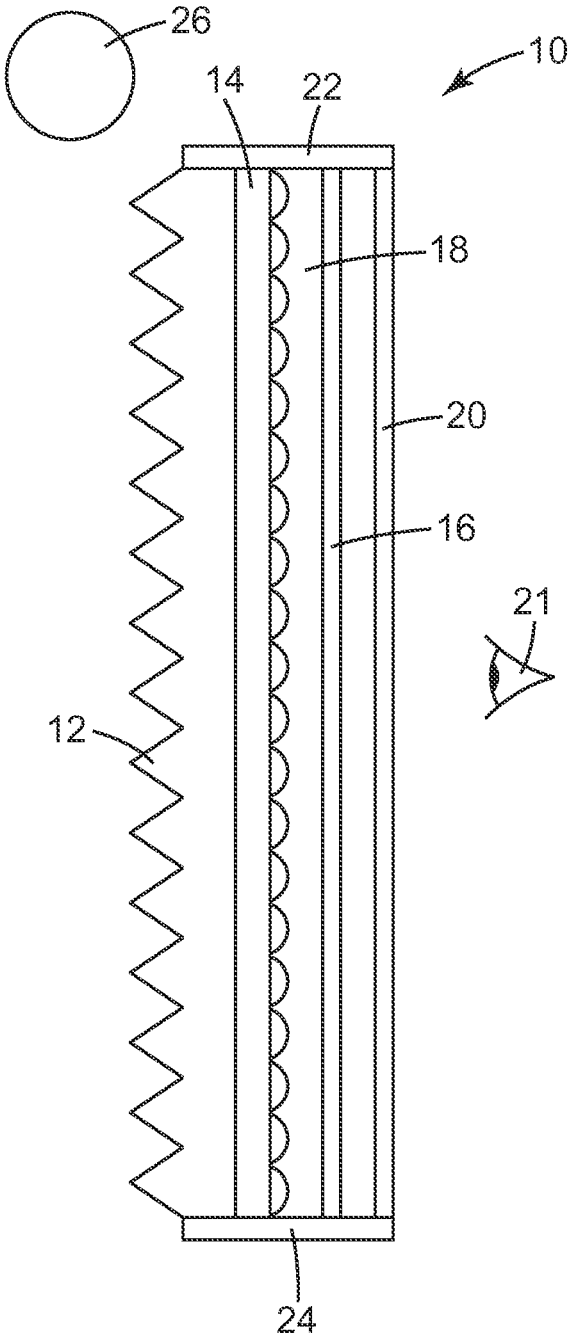
FIG. 1 is a side sectional view of self illuminated back lit signage.

Embodiments of this invention utilize ambient lighting or remotely located lighting to give a viewer the perception that a graphic has a powered backlight attached to it. In particular, the signage uses a turning film and one or more diffusers providing controlled diffusion in order to direct light toward the viewer of the graphic. This graphic signage can be used in a variety of ways such as with banner applications, advertising, point of purchase signage, traffic signage, or any sort of graphic in which it may be desirable to light the graphic without an active powered backlight Back Lit Signage FIG. 1 is a side sectional view of self illuminated back lit signage 10. Signage 10 includes a turning film 12, a first diffuser 14, a second diffuser 16, and a graphic 20. Signage 10 optionally includes an air gap 18 between diffusers 14 and 16. Alternatively, diffusers 14 and 16 can be in physical contact or, instead of an air gap, can be separated by an optically clear material. The films or components of signage 10 can optionally be held together and edge sealed by tape or frame 22 and 24, which typically surrounds the edges of the films. Graphic 20 can be printed on diffuser 16 or printed on a transparency applied to, for example laminated on, diffuser 16.

Turning film 12 can be implemented with a 60° prism film, for example, or other types of light redirecting films having a structured surface for redirecting light. Diffusers 14 and 16 can be implemented with lenticular diffusing films, for example, with the lenticulars facing toward or away from a viewer of graphic 20. The optional air gap 18 can help prevent damage to the lenticulars when lenticular diffusing films are used for the diffusers. The air gap also provides a refractive index difference. Diffuser 14 provides for diffusion in at least one direction while diffuser 16 provides for diffusion in a different direction. When implemented with a lenticular diffusing film, diffuser 14 preferably has the lenticulars extending in the same direction substantially parallel with the prisms of turning film 12. Preferably, diffusers 14 and 16 provide for diffusion in orthogonal directions, as illustrated in FIG. 1, to provide for better uniformity of illuminating graphic 20. Instead of two diffusers, only one diffuser 14 or 16 can alternatively be used. Also, diffusers 14 and 16 can be replaced by a single asymmetric diffuser. The lenticulars of diffusing film 14 can optionally be registered with the prisms of turning film 12, which can provide for more gain. A system for registering microreplicated features on opposite sides of a film is disclosed in U.S. Pat. No. 7,165,959, which is incorporated herein by reference as if fully set forth.

Figure 2:
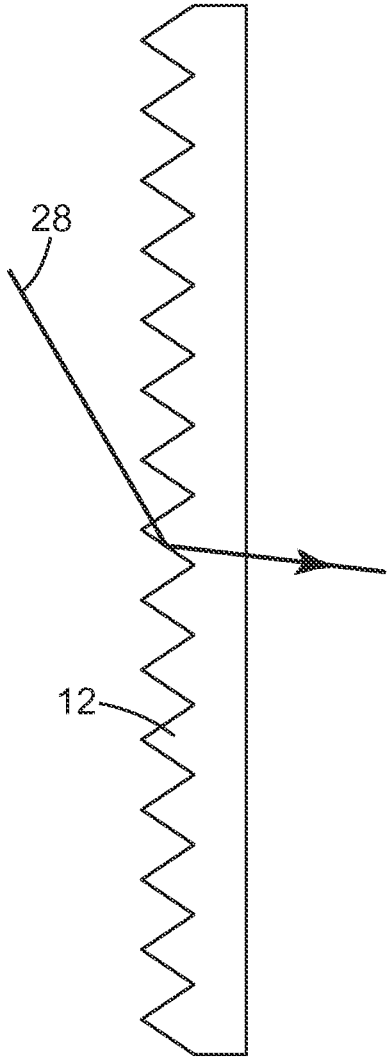
FIG. 2 is a diagram illustrating ray tracing for the signage of FIG. 1.

In use, the features (triangular prisms) in turning film 12 direct light from light source 26, such as a room light, to graphic 20 in order to passively illuminate the signage for a viewer 21. FIG. 2 is a diagram illustrating ray tracing for the signage of FIG. 1, represented by line 28 showing how turning film 12 directs light from room light 26 to graphic 20 and viewer 21 for the passive illumination.

Front Lit Signage

Figure 3:
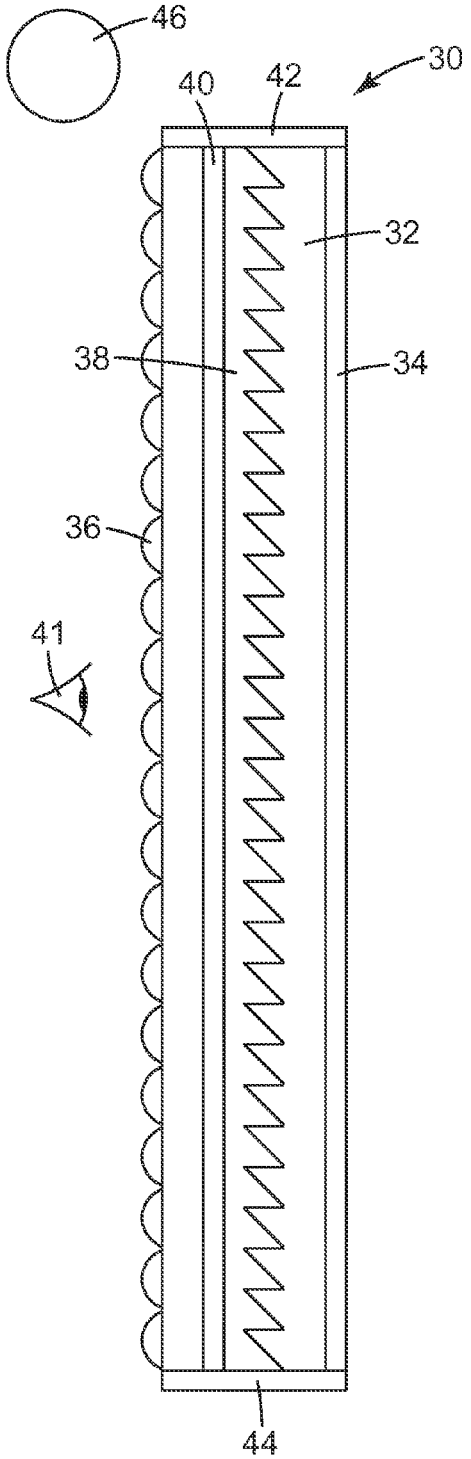
FIG. 3 is a side sectional view of self illuminated front lit signage.

FIG. 3 is a side sectional view of self illuminated front lit signage 30. Signage 30 includes a turning film 32, a reflector 34, a diffuser 36, and a graphic 40. Signage 30 optionally includes an air gap 38 between turning film 32 and graphic 40. Alternatively, turning film 32 and graphic 40 can be in physical contact or, instead of an air gap, can be separated by an optically clear material. The films or components of signage 30 can optionally be held together and edge sealed by tape or frame 42 and 44, which typically surrounds the edges of the films. Graphic 40 can be printed on diffuser 36 or printed on a transparency applied to, for example laminated on, diffuser 36.

Turning film 32 can be implemented with a sawtooth prism film, for example, or other type s of light redirecting films having a structured surface for redirecting light. For example, a linear Fresnel film can be used instead of a sawtooth prism film. Reflector 34 can be implemented with a specular reflector, for example the Enhanced Specular Reflector (ESR) film from 3M Company. In some cases the specular reflector can be structured so as to provide a limited amount of angular spreading. Specular reflectors with structure include, for example, metalized microstructured films. In some cases the reflector can be semi-specular in nature where the reflector provides a small amount of spreading or limited amount of diffusion for light incident on the reflector. Semi-specular reflectors include, for example, a lightly diffuse coating on ESR film. Diffuser 36 can be implemented with a lenticular diffusing film, for example, with the lenticulars arranged at 45° with respect to the prisms of turning film 32. When implemented with a lenticular diffusing film, the lenticulars can face toward or away from a viewer of graphic 40. Instead of a lenticular diffusing film, diffuser 36 can be implemented with an asymmetric diffuser. The optional air gap 38 can help prevent damage to the prisms of turning film 32. The air gap also provides a refractive index difference.

Figure 5:
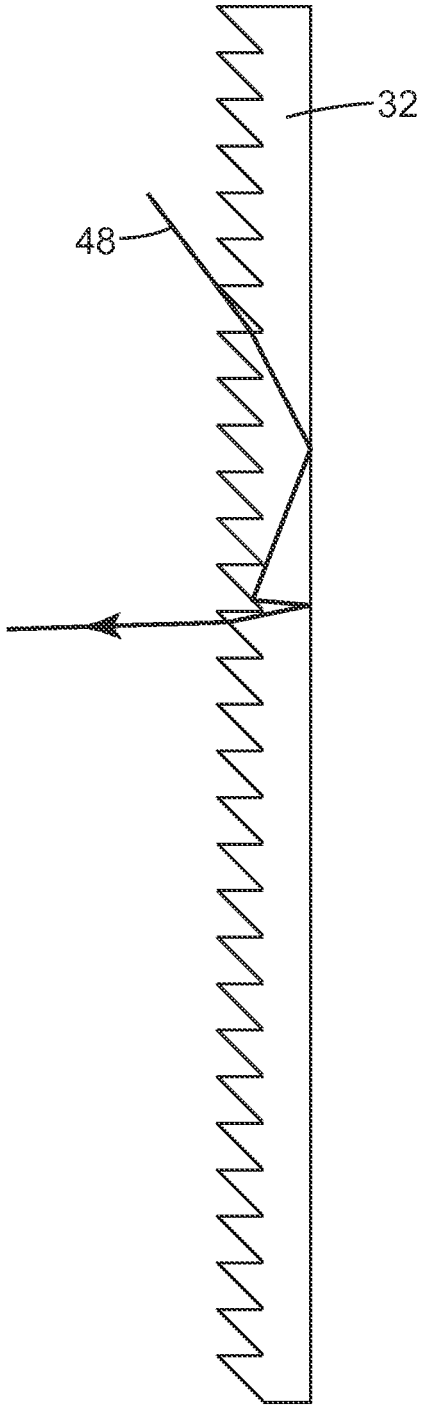
FIG. 5 is a diagram illustrating ray tracing for the signage of FIG. 3.

In use, the features (for example sawtooth prisms) in turning film 32 direct light from light source 46, such as a room light, to graphic 40 in order to passively illuminate the signage for a viewer 41. FIG. 5 is a diagram illustrating ray tracing for the signage of FIG. 3, represented by line 48 showing how turning film 32 directs light from room light 46 to graphic 40 and viewer 41 for the passive illumination.

Figure 4:
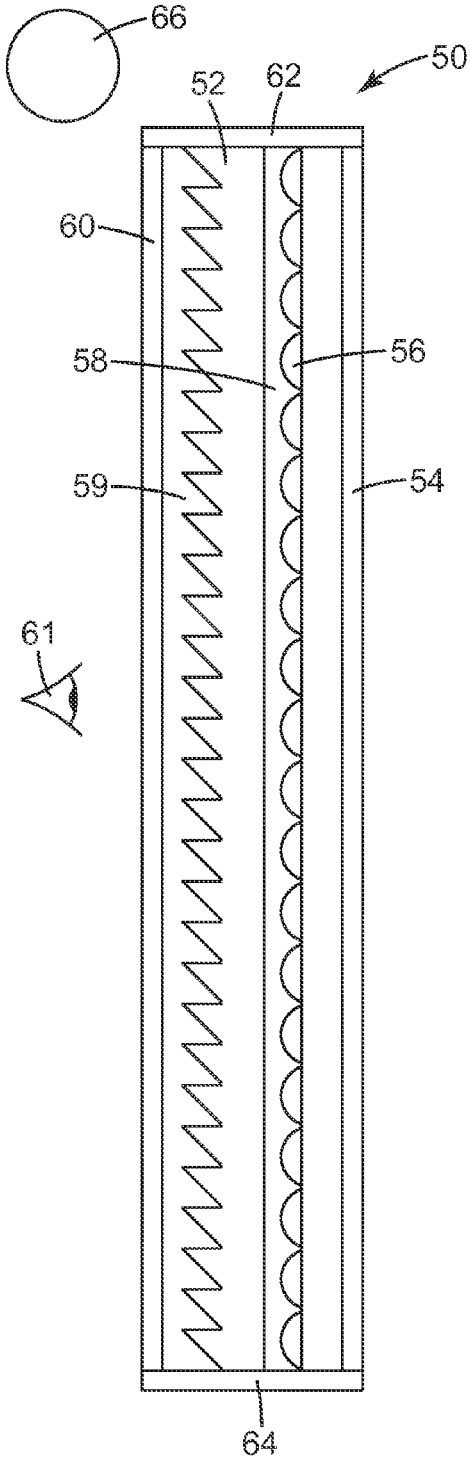
FIG. 4 is a side sectional view of an alternative construction of the signage of FIG. 3.

FIG. 4 is a side sectional view of front lit self illuminated signage 50, which is an alternative construction of signage 30. Signage 50 includes a turning film 52, a reflector 54, a diffuser 56, and a graphic 60. Signage 50 can also include an optional air gap 58 between turning film 52 and diffuser 56, and an optional air gap 59 between turning film 52 and graphic 60. An optional edge tape or frame 62 and 64 can be used around the edges of signage 50. In this alternative construction, the diffuser is placed behind the turning film (between the reflector and turning film) with graphic 60 remaining in front of the turning film from the viewer's perspective. In this alternative construction, the diffuser can be attached to the turning film through lamination or a microreplication process with the back side of the diffuser metalized to eliminate the need for a separate reflector. The components of signage 50 can be implemented with the components identified above for signage 30. In use, turning film 52 directs light from a light source 66 to graphic 60 and a viewer 61 in order to passively illuminate the signage.

For the signage described above, the remotely located or ambient light may be oriented either in front of or behind the graphic and possibly at a high angle depending on the specific signage design. The light sources (26, 46, 66) for the signage are shown proximate the signs for illustrative purposes only; the light sources can be located at a variety of positions and distances in front of the sign for front lit signs or behind the signs for back lit signs, including positioned at various angles with respect to the signs. Aside from or in addition to room lighting, the light source can include sunlight from a window, for example. The light source can also include a large area collimated light source. The signage is self illuminated, meaning it uses passive illumination and does not contain its own active light source.

For the self illuminated signage, when a film or component is recited as being on another film or component, the film or component can be directly on (in physical contact with) the other film or component, adjacent but not in physical contact with the other film or component, or partially directly on and partially adjacent the other film or component.

The signage including the graphic can be substantially planar, as shown, or optionally curved. For curved signage, the optional frame can be curved to hold the films of the signage in a curved arrangement. The graphic for the sign can include, for example, text, logos, drawings, images, branded shapes, photos, or any other static information. The static information can be provided as a print on any type of substantially transparent and substantially non-diffusing substrate, for example polymeric films or transparent inorganic glass. In some embodiments the static information can comprise a solid color surface, which can optionally also be a structured surface. In some embodiments the static information can comprise a multi-color surface, which can optionally also be a structured surface. The information for the graphic is contained on the signage and is not projected onto it. However, the self illumination of the signage may provide the appearance of a projected image due to the lighting of the graphic. Also, depending upon the types of diffuser or other films used in the signage, the graphic may have the appearance of a 3D or floating image.

An alternative construction of the front lit sign can include the design described above except the sign can incorporate a curve in the repeated pattern in order to always have the active face of the features largely face the light source. The center of the radius of curvature of the repeated prism pattern can be such that it largely lies at the projected center of the light source located directly above the sign. This design can produce a single bright spot, indicating that the specular reflections are well controlled. A diffuser can be used to spread the output to a usable width. This construction can be used with a near source as the light source.

EXAMPLES

Samples were made and tested to show the gain in brightness of self illuminated signs over vinyl signs. These examples are merely for illustrative purposes only.

Test Methods—Luminance Measurement

Samples were placed on edge in a room lit with artificial light. Luminance measurements were made using a Minolta Luminance Meter LS-100 (available from Konica Minolta Sensing Singapore Pte Ltd). A 10.2 cm diameter area without printing (no color) was measured for front lit examples. A 7.6 cm diameter area without printing (no color) was measured for backlit examples. Luminance values are expressed in units of cd/m$^2$ and recorded in Table 1. Gain was calculated by dividing the luminance value of the sample by the luminance value of the associated comparative white vinyl sample, and the results are recorded in Table 1.

Graphic Layer

The graphic prints were created on 50.8 micron transparent vinyl film #180C-151-114 and 50.8 micron white vinyl film #180C-151-010 (both available from 3M Company, St. Paul, Minn.) using a Mimaki UJV-160 UV large format printer (available from Mimaki USA, Suwanee, Ga.).

Example 1

Sample Construction Front Lit Sign

The following 20.3 cm by 27.9 cm films (arranged in the following order) were passed through a 3M 1174 Roll laminator (available from 3M Company, St. Paul, Minn.) at room temperature.

Lenticular diffuser consisting of microreplicated linear lens features with a radius of curvature of 0.054 mm and a pitch of 0.028 mm oriented at 45 degree on one side of 126 micron PET film with structured side up. The process to impart structure to one or both sides of a film is described in U.S. Pat. No. 7,224,529.

Optically clear adhesive transfer tape, 8171, 25.4 micron thickness, available from 3M Company, St. Paul, Minn.

Graphic print on transparent vinyl as noted above with ink side to adhesive.

Turning film consisting of microreplicated 60 degree steps, 0.0825 mm on one side of 126 micron PET film with structured side up.

Optically clear adhesive transfer tape, 8171, 25.4 micron thickness, available from 3M Company, St. Paul, Minn.

VIKUITI ESR film, available from 3M Company, St. Paul, Minn.

This film stack was then sealed around all four edges with 3M F9460PC VHB Adhesive Transfer Tape, available from 3M Company, St. Paul, Minn. The sample was tested for luminance using the test method described above. The lenticular diffuser surface of the film stack was facing the measurement device. Results are recorded in Table 1.

Comparative Example 1

Sample Construction Front Lit Sign

A sign was made using graphic print on white vinyl as noted above. The sample was tested for luminance using the test method described above. The ink surface of the film was facing the measurement device. Results are recorded in Table 1.

Example 2

Sample Construction Front Lit Sign

A sign was constructed the same as Example 1 but with an additional layer of optically clear adhesive transfer tape, 8171, 25.4 micron thickness (available from 3M Company, St. Paul, Minn.) between the graphic print and the turning film. The sample was tested for luminance using the test method described above. The lenticular diffuser surface of the film stack was facing the measurement device. Results are recorded in Table 1.

Example 3

Sample Construction Back Lit Sign

The following 20.3 cm by 27.9 cm films (arranged in the following order) were passed through a 3M 1174 Roll laminator (available from 3M Company, St. Paul, Minn.) at room temperature.

254 micron thick PET film.

Registered 2 sided turning film, prism side facing up (see FIG. 1), on 76 micron PET film, which is described as double sided prism film in U.S. Pat. No. 7,224,529.

Graphic print on transparent vinyl as noted above with ink side down.

Optically clear adhesive transfer tape, 8171, 25.4 micron thickness, available from 3M Company, St. Paul, Minn.

X axis lenticular diffuser consisting of microreplicated linear lens structures with a radius of curvature of 0.471 mm and a pitch of 0.254 mm on one side of 76 micron PET with structure side up.

This film stack was then sealed around all four edges with 3M F9460PC VHB Adhesive Transfer Tape, available from 3M Company, St. Paul, Minn. A 61 cm by 91 cm mirror was placed under and behind the sign. The mirror was placed facing up. The sample was tested for luminance using the test method described above. The X axis lenticular diffuser surface of the film stack was facing the measurement device. Results are recorded in Table 1.

Comparative Example 2

Sample Construction Back Lit Sign

A sign was made using graphic print on white vinyl as noted above. The sample was tested for luminance using the test method described above. The ink surface of the film was facing the measurement device. Results are recorded in Table 1.

Example 4

Sample Construction Back Lit Sign

The following 35.5 cm by 104.1 cm films (arranged in the following order) were passed through a 3M 1174 Roll laminator (available from 3M Company, St. Paul, Minn.) at room temperature.

Turning film consisting of microreplicated 60 degree steps, 0.047 mm on one side of 76 micron PET film with structured side facing up.

Optically clear adhesive transfer tape, 8171, 25.4 micron thickness, available from 3M Company, St. Paul, Minn.

X axis lenticular diffuser consisting of microreplicated linear lens structures with a radius of curvature of 0.471 mm and a pitch of 0.254 mm on one side of 76 micron PET film with structure side down.

Y axis lenticular diffuser consisting of microreplicated linear lens structures with a radius of curvature of 0.471 mm and a pitch of 0.254 mm on one side of 76 micron PET film with structure side up.

Optically clear adhesive transfer tape, 8171, 25.4 micron thickness, available from 3M Company, St. Paul, Minn.

Graphic print on transparent vinyl as noted above with ink side down.

This film stack was then sealed around all four edges with 3M F9460PC VHB Adhesive Transfer Tape, available from 3M Company, St. Paul, Minn. The sample was tested for luminance using the test method described above. The graphic print ink surface of the film stack was facing the measurement device. Results are recorded in Table 1.

Comparative Example 3

Sample Construction Back Lit Sign

A sign was made using graphic print on white vinyl as noted above with ink side out. The sample was tested for luminance using the test method described above. The ink surface of the film was facing the measurement device. Results are recorded in Table 1.

TABLE 1

Luminance and Gain

| Sample # | Luminance (cd/m$^2$) | Gain |
|---|---|---|
| Example 1 - Front Lit | 490 | 3.27 |
| Example 2 - Front Lit | 412 | 2.75 |
| Comparative Example 1 | 150 | 1.00 |
| Example 3 - Back Lit | 450 | 4.74 |
| Comparative Example 2 | 95 | 1.00 |
| Example 4 - Back Lit | 370 | 3.88 |
| Comparative Example 3 | 95.3 | 1.00 |

The invention claimed is:

1. A self illuminated front lit sign, comprising:

a diffuser for providing diffusion in at least one direction;

a graphic on the diffuser;

a turning film having a first structured surface for redirecting light and a second surface opposite the first surface, wherein the turning film is on a side of the graphic opposite the diffuser and the first structured surface faces the graphic; and a reflector on the second surface of the turning film, wherein the turning film directs light via the first structured surface from in front of the sign toward a viewer of the graphic in order to passively illuminate the sign.

2. The sign of claim 1, wherein the graphic is printed on the diffuser.

3. The sign of claim 1, wherein the graphic is printed on a film attached to the diffuser.

4. The sign of claim 1, further comprising an air gap between the diffuser and the turning film.

5. The sign of claim 1, wherein the diffuser comprises an asymmetric diffuser.

* * * * *